US009587914B2

(12) United States Patent
Shoshan et al.

(10) Patent No.: US 9,587,914 B2
(45) Date of Patent: Mar. 7, 2017

(54) ARMOR COUPLER

(71) Applicant: Plasan Sasa Ltd., M.P. Marom Hagalil (IL)

(72) Inventors: Amir Ben Shoshan, D.N. Chevel Korazim (IL); Amir Laor, Kibbutz Dan (IL); Eitan Yakobi, Moshav Yonatan (IL)

(73) Assignee: PLASAN SASA LTD., M.P. Marom Hagalil (IL)

( * ) Notice: Subject to any disclaimer, the term of this patent is extended or adjusted under 35 U.S.C. 154(b) by 46 days.

(21) Appl. No.: 14/684,596

(22) Filed: Apr. 13, 2015

(65) Prior Publication Data

US 2015/0292838 A1 Oct. 15, 2015

(30) Foreign Application Priority Data

Apr. 13, 2014 (IL) ..... 232110

(51) Int. Cl.
*F41H 5/02* (2006.01)
*F41H 5/013* (2006.01)

(52) U.S. Cl.
CPC ..... *F41H 5/013* (2013.01); *F41H 5/02* (2013.01); *F41H 5/023* (2013.01)

(58) Field of Classification Search
CPC ... F41H 5/00; F41H 5/02; F41H 5/013; F41H 5/007
USPC ..... 89/36.01–36.17
See application file for complete search history.

(56) References Cited

U.S. PATENT DOCUMENTS 4,398,446 A * 8/1983 Pagano ..... F41H 5/013 89/36.08
4,545,286 A * 10/1985 Fedij ..... F41H 5/007 109/85
4,716,810 A * 1/1988 DeGuvera ..... F41H 5/013 109/83
4,905,569 A * 3/1990 Seksaria ..... F41H 5/013 52/202
5,007,326 A * 4/1991 Gooch, Jr. ..... F41H 5/013 109/85
5,033,357 A * 7/1991 Seksaria ..... F16B 5/0233 403/167
5,083,515 A * 1/1992 Seksaria ..... F41H 5/013 109/49.5
5,131,314 A * 7/1992 Hansen ..... F41H 5/013 109/79
8,469,330 B2 6/2013 Adams et al.
(Continued)

FOREIGN PATENT DOCUMENTS

AU 2013200527 8/2013
EP 2505953 10/2012
(Continued)

*Primary Examiner* — Jonathan C Weber
(74) *Attorney, Agent, or Firm* — Dorsey & Whitney LLP

(57) ABSTRACT

A coupler for the attachment of an armor panel to a structure to be protected, the coupler having a first end unit configured for attachment to the armor panel and a second end unit configured for attachment to the structure, the units being axially spaced from one another by an elongated plate member having, in cross-section taken along a plane perpendicular to the axial direction, an asymmetric shape allowing the plate to be differently susceptible to bending forces in at least two different directions.

12 Claims, 5 Drawing Sheets

(56) References Cited

U.S. PATENT DOCUMENTS

| | | | | |
|---|---|---|---|---|
| 8,539,873 | B2 * | 9/2013 | Gonard | F41H 5/023 89/36.01 |
| 8,746,121 | B2 * | 6/2014 | Hubsch | F41H 5/023 89/36.01 |
| 2006/0213360 | A1 * | 9/2006 | Ravid | F41H 5/013 89/36.01 |
| 2008/0257141 | A1 * | 10/2008 | Medwell | F41H 5/013 89/36.02 |
| 2010/0043629 | A1 * | 2/2010 | Carberry | E04H 9/10 89/36.02 |
| 2011/0113952 | A1 * | 5/2011 | Rosenwasser | F41H 5/013 89/36.02 |
| 2011/0232472 | A1 * | 9/2011 | Kellner, Jr. | F41H 5/013 89/36.08 |
| 2012/0152101 | A1 * | 6/2012 | Engleman | F41H 5/026 89/36.08 |
| 2012/0255431 | A1 * | 10/2012 | Hubsch | F41H 5/023 89/36.08 |
| 2012/0291616 | A1 * | 11/2012 | Andrewartha | F41H 5/026 89/36.02 |
| 2013/0092017 | A1 | 4/2013 | Bridewell | |
| 2014/0041517 | A1 * | 2/2014 | Leeming | F41H 5/04 89/36.02 |
| 2014/0338520 | A1 * | 11/2014 | Bourke | F41H 5/023 89/36.02 |

FOREIGN PATENT DOCUMENTS

| | | |
|---|---|---|
| EP | 2551628 | 1/2013 |
| GB | 2506570 | 4/2014 |
| WO | WO 2009/064263 | 5/2009 |
| WO | WO2011161399 | 12/2011 |
| WO | WO 2013043108 | 3/2013 |

* cited by examiner

ARMOR COUPLER

TECHNOLOGICAL FIELD

Embodiments of the invention are related to a coupling arrangement configured for attachment of armor panels to a body to be protected.

BACKGROUND

It is known in the art to protect vehicles and structures from incoming threats (bullets, RPG, missiles etc.) by attaching armor panels and armor systems onto and external surface/s thereof. It is also known to attach such armor panels at a stand-off distance from the external surface, providing a safe distance by which the impact and/or explosion of the threat upon impact with the armor panel does not directly influence the vehicle/structure.

In particular, attaching armor panels to a vehicle at a stand-off distance increases the dimensions of the vehicle (e.g. width), reducing mobility and causing the armor panel to impact various obstacles. This, in turn, may lead to damage to the armor panel which can deteriorate the ballistic capability thereof.

One way of overcoming this deficiency is using flexible couplers configured to provide the armor panel with a certain degree of freedom, allowing it to displace upon impact with obstacles, thereby decreasing the damage caused thereto.

One example of an arrangement configured for overcoming this problem is disclosed in WO11161399, which discloses an armor mounting systems comprising a flexible bracket for attaching armor to a vehicle, the flexible bracket comprising an elongate member connected between a vehicle and an attached armor elements. The elongate member is resilient enough to support the attached armor elements and return the armor elements to their normal resting position following disturbance. The armor mounting system is beneficial in reducing damage to attached armor during maneuver Acknowledgement of the above references herein is not to be inferred as meaning that these are in any way relevant to the patentability of the presently disclosed subject matter.

GENERAL DESCRIPTION

According to one aspect of the subject matter of the present application there is provided a coupler for the attachment of an armor panel to a structure to be protected, said coupler having a first end unit configured for attachment to the armor panel and a second end unit configured for attachment to the structure, the units being axially spaced from one another by an elongated plate member having, in cross-section taken along a plane perpendicular to the axial direction, an asymmetric shape allowing the plate to be differently susceptible to bending forces in at least two different directions.

The asymmetric cross-sectional shape of the plate member can be such that it provides the plate member with a first moment of inertia in a first direction and a second moment of inertia in a second direction, different than the first moment of inertia. In particular, both the first direction and the second directions can be perpendicular to the axial direction, and, in addition, be perpendicular to each other.

According to a particular example, the cross-section of the plate member can be inscribed in a rectangle having a height h and a width b wherein h>>b. As such, the plate member can have a high moment of inertia for bending along an axis parallel to the height direction h and a considerably lower moment of inertia for bending along an axis perpendicular to the width direction b.

The coupler can further comprise a restraining sleeve encapsulating at least a portion of the plate member or even in its entirety configured for preventing, or at least considerably reducing vibrations occurring in the plate member, if attached to a movable structure.

According to a particular example, the cross-sectional area of the plate member can occupy less than half of the cross-sectional area of at least one of the end units, more particularly, less than 25% of the cross-sectional area of at least one of the end units and even more particularly less than 10% of the cross-sectional area of at least one of the end units.

Following the above example, it is understood that, when the restraining sleeve extends the entire length between the end units, it occupies the majority of the volume defined between the end units.

The restraining sleeve can be made a variety of flexible/resilient/pliable materials which can include (but not limited to) rubber, cork, polyurethane, polyurea and other elastomer materials.

The asymmetric shape of the plate member allows, when mounting the armor panel to the structure to be protected, to adjust the orientation of the coupler so as to suit expected direction of impact of obstacles, i.e. expected direction of forces causing a bending moment in the coupler. Thus, the change in orientation allows the plate to be differently susceptible to bending in at least two different directions.

For example, if it known that a certain portion of the armor, or a certain armor panel, are susceptible to impact in a certain direction, e.g. portions of the armor closer to the bottom of the vehicle which are more likely to be impacted from the bottom, then the orientation of the coupler/s at the location of the orientation of that portion can be adjusted to provide the necessary flexibility of the coupler.

When mounted on the vehicle, the couplers by which an armor panel is attached to the vehicle can be arranged such that the width b corresponds to the horizontal direction (usually defined by a ground surface on which the vehicle is positioned), and the height h corresponds to the height axis of the vehicle (perpendicular to the ground).

Under such an arrangement, the couplers are provided, on the one hand, with a low bending moment of inertia in the vertical direction, preventing sagging or lowering of the armor plate with respect to the vehicle, and on the other hand, with a sufficient degree of freedom allowing the armor panel to slightly displace in the horizontal direction as a result of impact with various obstacles.

In addition, the orientation of the coupler units can be adjusted according to the desired reaction to be achieved therefrom. In particular, the angle of the plate member with respect to the height axis can be adjusted.

According to a particular example, in an armor plate comprising two or more rows of couplers holding the armor plate/s in place, the bottom row is more likely to be impacted from below than do the other rows of couplers located above it. It may therefore be advantageous to orient the bottom row of couplers at an angle (e.g. 45°) with respect to the horizontal direction, providing them with a certain degree of freedom also along the vertical direction, while still preventing sagging.

According to another aspect of the subject matter of the present application, there is provided an array of couplers according to the previous aspect, configured for attachment of one or more armor panels to a body to be protected, wherein the orientation of the couplers is chosen in accordance with an expected impact direction of external obstacles on the armor panel.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1:
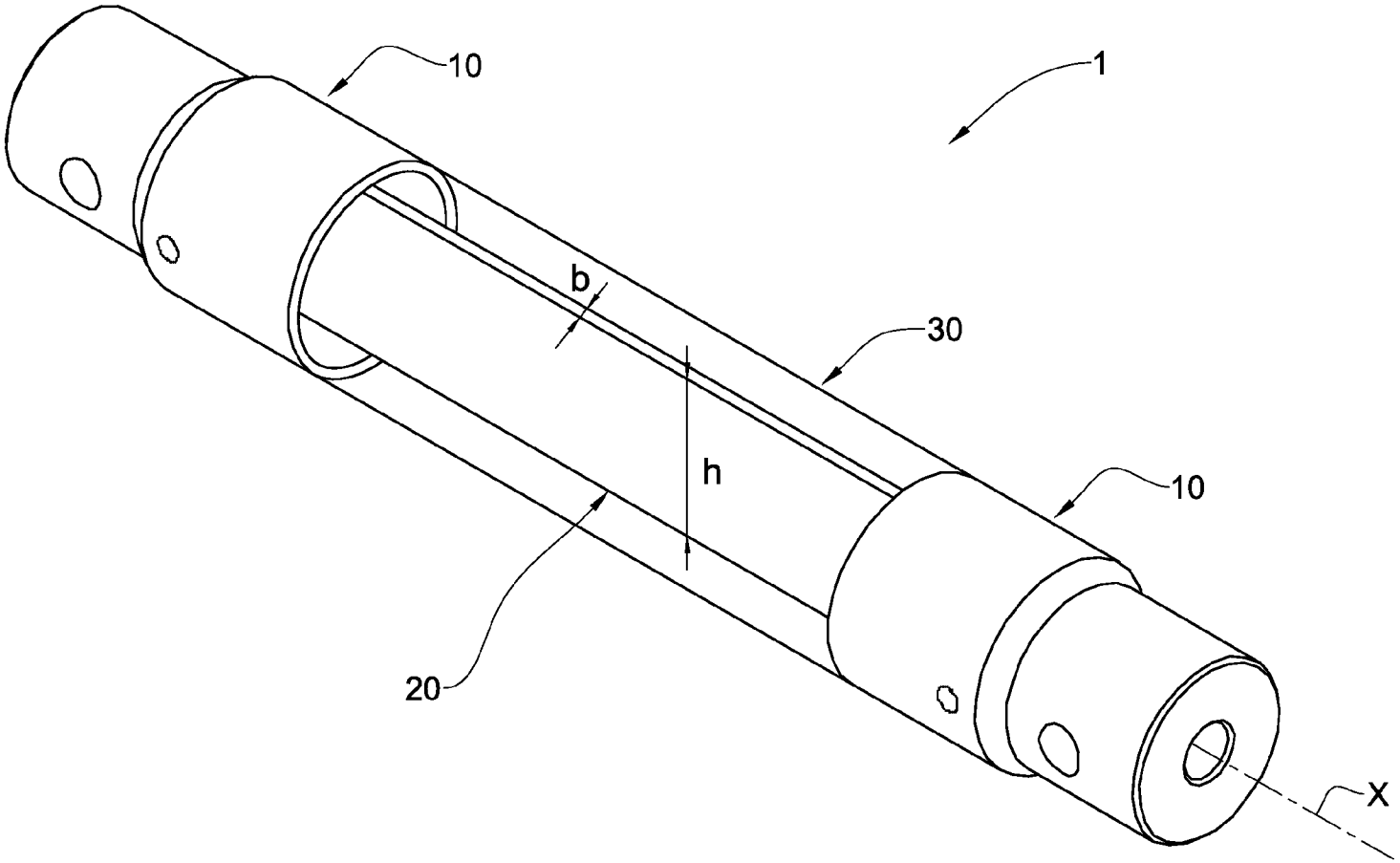
FIG. 1 is a schematic isometric view of a coupler according to the subject matter of the present application.

Attention is first drawn to FIG. 1, in which a coupler is shown, generally designated 1, and configured for attachment between an armor panel A (shown FIGS. 4A, 4B) and a body to be protected B.

The coupler 1 comprises a first and second end units 10, holding therebetween a plate member 20 encapsulated in a restraining sleeve 30. In the present example, each of the end units is of cylindrical configuration, defining a longitudinal axis of the coupler, along which the plate member 20 is disposed.

Figure 2A:
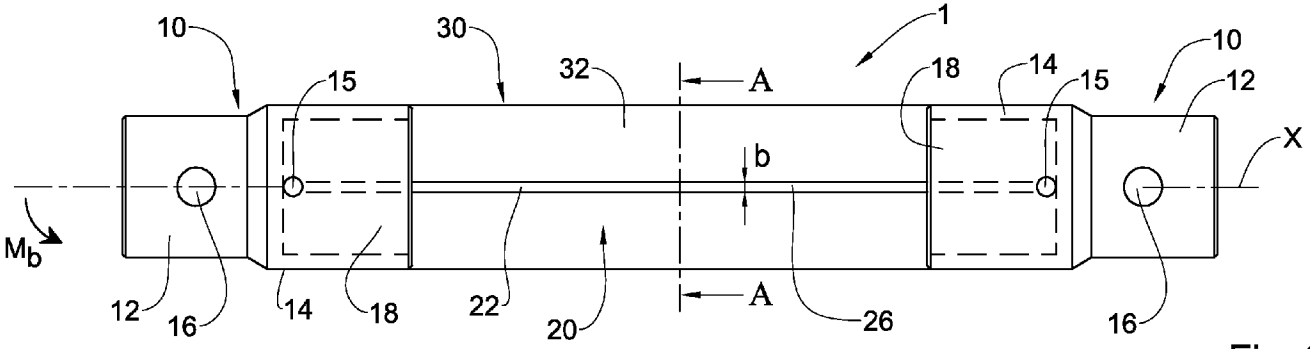
FIG. 2A is a schematic top view of the coupler shown in FIG. 1.
Figure 2B:
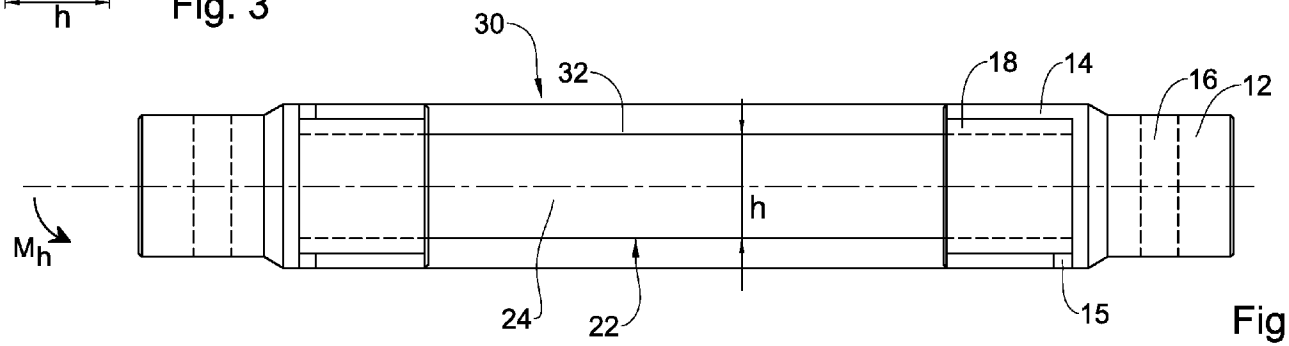
FIG. 2B is a schematic front view of the coupler shown in FIG. 1.

With additional reference to FIGS. 2A and 2B, one end unit is configured for fixed attachment to the armor panel A and the other for fixed attachment to the body to be protected B. Each end unit comprises a first segment 12 configured for attachment to the armor panel A and/or body to be protected B via designated bores 16.

Each end unit further comprises a second segment 14 configured for attachment to the plate member 20, an end of which is configured for being received within a designated cavity 18 of the second segment 14. Fastening of the plate member 20 to the end units 10 is performed via bores 15.

Figure 3:
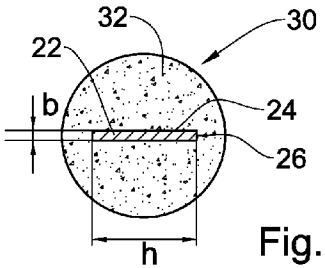
FIG. 3 is a schematic cross-section view, taken along the section plane A-A, of the coupler shown in FIG. 1.

The plate member 20 has a main body 22 having an asymmetric cross-section. In particular, with additional reference to FIG. 3, the plate member has a wide end surface 24 and a short end surface 26, such that in cross-section taken along a plane perpendicular to the longitudinal direction of the plate member 20 (e.g. plane A-A which is also perpendicular to the longitudinal axis of the coupler), the cross-section has a height h and a thickness b, such that b<<h.

It is appreciated that the above cross-section yields a different moment of inertia in the height direction (h) than in the thickness direction (b), i.e. the plate member 20 is more susceptible for bending in the direction of moment Mb (shown in FIG. 2A) than to bending in the direction of moment Mh (shown in FIG. 2B).

Figure 5A:
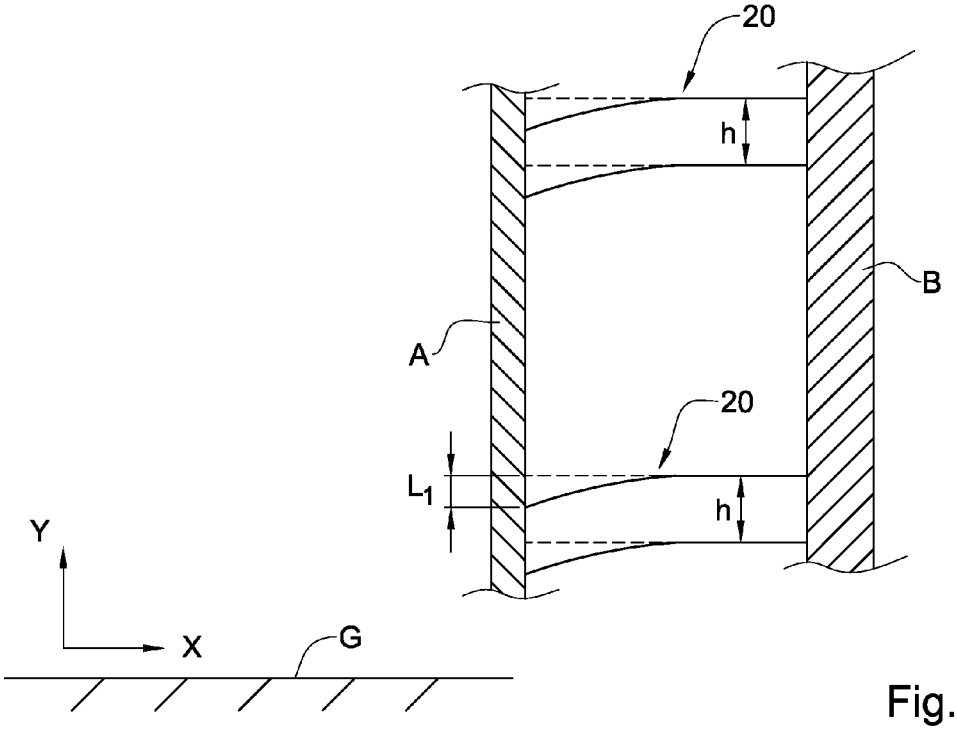
FIG. 5A is a schematic side view of an armor panel attached to a vehicle using the coupler shown in FIGS. 1 to 3.
Figure 5B:
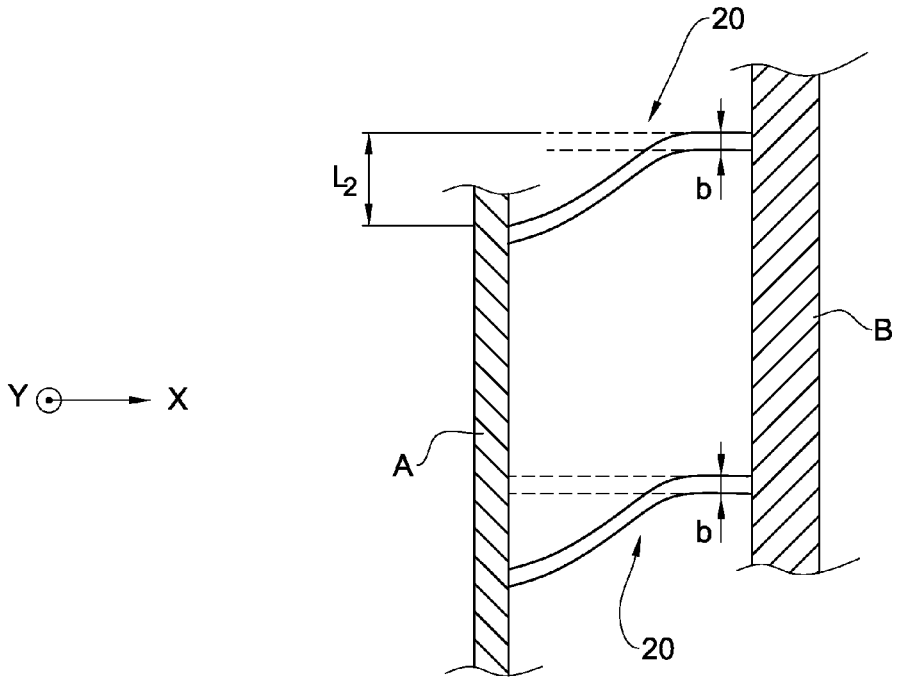
FIG. 5B is a schematic top view of the armor panel attached to the vehicle shown in FIG. 5A.

With particular reference being drawn to FIGS. 5A and 5B, it is noted that due to the difference in the moments of inertia along the different directions of the plate member 20, when an armor panel is mounted on to the vehicle using the coupler 1 when the wide side h of the plate member 20 extends along the vertical direction, the coupler 1 is more resistant to bending (by gravitational forces), and the sagging thereof L1 is relatively small.

However, the armor panel's A resistance to forces applied in the lateral direction (see FIG. 5B), is considerably lower, whereby the coupler can experience substantial displacement L2>>L1.

It is noted that the sleeve 30 is configured for preventing the plate member 20 from bending too much and from going into resonating vibration. In other words, the sleeve member 30 restraints the deformation and vibration of the plate member 20 and urges it to return to its original shape and orientation. The sleeve member can be produced of a variety of materials such as cork, rubber, silicone, polyurea, elastic foam etc.

Under the above arrangement, the armor panel has a fairly rigid configuration in the vertical direction, preventing sagging thereof, while being fairly flexible in the lateral direction, allowing it to bend when exposed to impact by obstacles etc. It is noted that affixing the armor panel to the vehicle in a completely rigid manner, can result in such impact destroying the armor panel or detaching it from the vehicle.

Figure 4A:
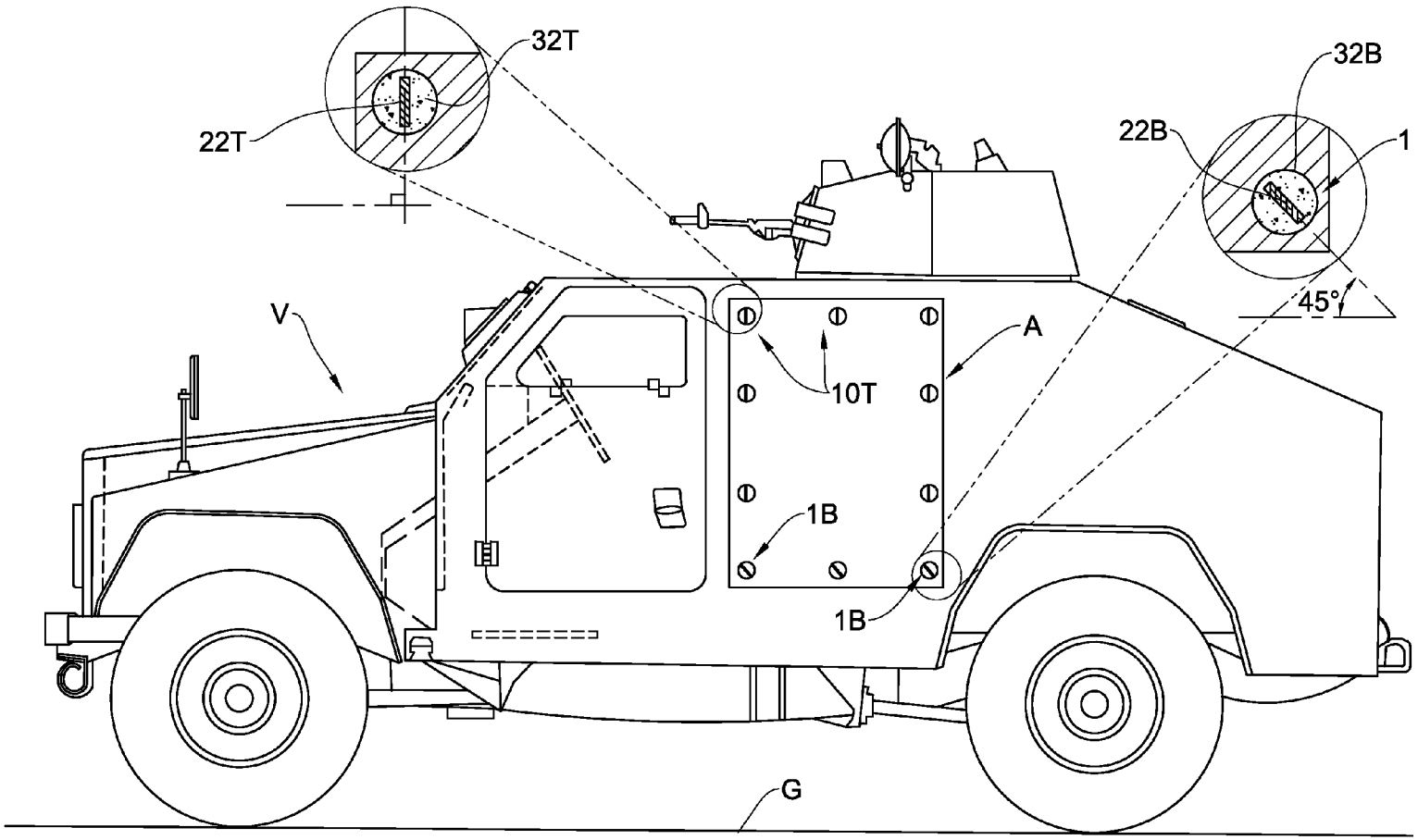
FIG. 4A is a schematic view of an armored vehicle comprising a flexible armor panel mounted thereon using the coupler shown in FIGS. 1 to 3.

Turning now to FIG. 4A, an armored vehicle V is shown having mounted thereon a flexible armor panel A, attached to the vehicle using 10 couplers 1 disposed along the circumference thereof. It is observed that whereas the majority of couplers 1A have a vertical orientation of the plate member 20 (as shown in FIGS. 5A, 5B), the bottom row of couplers 1B are angled at 45°. It is noted that the bottom portion of the armor panel A is more susceptible to blows coming from below (i.e. upward forces) than the rest of the armor panel, and so the 45° angle provides the bottom portion of the armor panel A with certain flexibility in the vertical direction as well.

The above arrangement is particularly useful when using a flexible armor panel (e.g. a foam matrix retaining therein armor elements), since deformation in one region of the armor panel is not necessarily transmitted to other regions thereof.

Figure 4B:
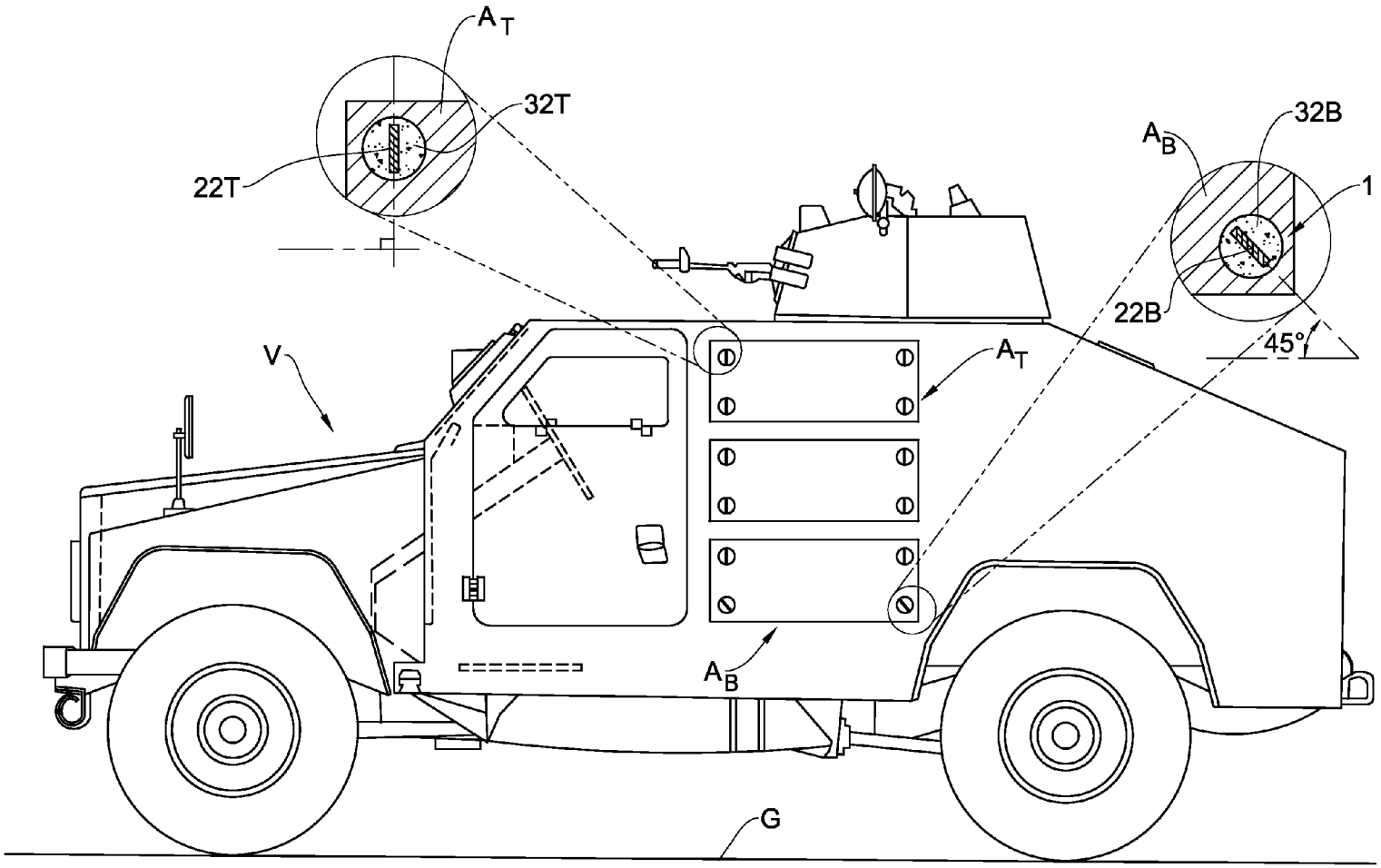
FIG. 4B is a schematic view of an armored vehicle comprising several flexible armor panels mounted thereon using the coupler shown in FIGS. 1 to 3.

Turning now to FIG. 4B, another example is shown of an armored vehicle V having mounted thereon a top armor panel $A_T$, a middle armor panel and a bottom armor panel $A_B$. It is observed that whereas the top and middle couplers have a vertical orientation of the plate member 20, the bottom armor panel has its couplers 1B angled at 45°, for the same reasoning provided above.

It is noted that since the armor panels in this example are rigid, all the couplers of a certain armor panel are preferably oriented in the same way since deformation in one region of the armor panel is transmitted to other regions thereof as well.

Those skilled in the art to which this invention pertains will readily appreciate that numerous changes, variations, and modifications can be made without departing from the scope of the invention, mutatis mutandis.

The invention claimed is:

1. A coupler for attachment of an armor panel to a structure to be protected, the coupler comprising:

a first end unit configured for attachment to the armor panel;

a second end unit configured for attachment to the structure;

an elongated plate member by which the first and second units are axially spaced from one another; wherein the elongated plate member has, in cross-section taken along a plane perpendicular to an axial direction, an asymmetric shape allowing the elongated plate member to be differently susceptible to bending forces in at least two different directions; and a restraining sleeve encapsulating at least a portion of or an entirety of the elongated plate member, the restraining sleeve configured for preventing or at least substantially reducing vibrations occurring in the elongated plate member when the elongated plate member is attached to a movable structure.

2. The coupler according to claim 1, wherein the asymmetric shape of the elongated plate member is such that asymmetric shape provides the elongated plate member with a first moment of inertia in a first direction and a second moment of inertia in a second direction, different than the first moment of inertia.

3. The coupler according to claim 1, wherein each of the first direction and the second direction is generally perpendicular to the axial direction, and wherein each of the first direction and the second direction is additionally generally perpendicular to each other.

4. The coupler according to claim 1, wherein the elongated plate member has a cross-section inscribed in a rectangle having a height h and a width b, wherein h>>b.

5. The coupler according to claim 4, wherein the elongated plate member has a high moment of inertia for bending along an axis parallel to the height direction h and a substantially lower moment of inertia for bending along an axis perpendicular to the width direction b.

6. The coupler according to claim 1, wherein the restraining sleeve is made of a material that is flexible, resilient, and pliable.

7. The coupler according to claim 6, wherein the material includes at least one of the following: rubber, cork, polyurethane, polyurea, or silicone.

8. The coupler according to claim 1, wherein the elongated plate member has a cross-sectional area that occupies less than half of a cross-sectional area of at least one of the first or second end units.

9. The coupler according to claim 8, wherein the cross-sectional area occupies less than 25% of the cross-sectional area of at least one of the first or second end units.

10. The coupler according to claim 8, wherein the cross-sectional area occupies less than 10% of the cross-sectional area of at least one of the first or second end units.

11. An array of couplers for attachment of one or more armor panels to a body to be protected, the array of couplers comprising:

a number of couplers each of which has an orientation chosen in accordance with an expected impact direction of external obstacles on the one or more armor panels, each of the number of couplers including:

a first end unit configured for attachment to the one or more armor panels;

a second end unit configured for attachment to the body;

an elongated plate member by which the first and second units are axially spaced from one another; wherein the elongated plate member has, in cross-section taken along a plane perpendicular to the axial direction, an asymmetric shape allowing the elongated plate member to be differently susceptible to bending forces in at least two different directions; and a restraining sleeve encapsulating at least a portion of or an entirety of the elongated plate member, the restraining sleeve configured for preventing or at least substantially reducing vibrations occurring in the elongated plate member when the elongated plate member is attached to a movable structure.

12. The array of couplers according to claim 11, wherein the one or more armor panels includes a bottom portion having each of the number of couplers thereof oriented at about 45°.

* * * * *